US006618877B2

(12) United States Patent
Stephen

(10) Patent No.: US 6,618,877 B2
(45) Date of Patent: Sep. 16, 2003

(54) ELEVATED INFANT CRIB DESIGNED FOR WHEELCHAIR ACCESS

(76) Inventor: David P. Stephen, 1915 Zang St., Golden, CO (US) 80401

( * ) Notice: Subject to any disclaimer, the term of this patent is extended or adjusted under 35 U.S.C. 154(b) by 0 days.

(21) Appl. No.: 10/042,791

(22) Filed: Jan. 8, 2002

(65) Prior Publication Data

US 2003/0126680 A1 Jul. 10, 2003

(51) Int. Cl.[7] ..... A47D 13/06

(52) U.S. Cl. ..... 5/93.1; 5/100; 5/425; 5/428; 5/429

(58) Field of Search ..... 5/93.1, 100, 425, 5/428, 429

(56) References Cited

U.S. PATENT DOCUMENTS

| | | | | |
|---|---|---|---|---|
| 1,391,566 | A | | 9/1921 | Musselman |
| 2,109,267 | A | | 2/1938 | Grosser |
| 2,442,048 | A | | 5/1948 | Kroll et al. |
| D156,678 | S | | 12/1949 | Stettner |
| 2,662,231 | A | | 12/1953 | King |
| 3,345,653 | A | * | 10/1967 | Mixon ..... 5/97 |
| 3,403,412 | A | | 10/1968 | Gottfried et al. |
| 3,797,053 | A | | 3/1974 | Mamo |
| 4,715,075 | A | * | 12/1987 | Shamie ..... 5/93.1 |
| 4,811,436 | A | | 3/1989 | Schwartz |
| 4,894,581 | A | * | 1/1990 | Roberts ..... 312/305 |
| 4,937,902 | A | | 7/1990 | Ceike Shapiro |
| 5,093,945 | A | | 3/1992 | Schoonover et al. |
| D371,013 | S | | 6/1996 | Smalls et al. |
| 5,535,457 | A | | 7/1996 | Welsh, Jr. et al. |
| 5,742,959 | A | | 4/1998 | Froelich |
| 5,926,870 | A | | 7/1999 | Brana-Barnes et al. |

* cited by examiner

*Primary Examiner*—Teri Pham Luu
(74) *Attorney, Agent, or Firm*—John E. Reilly; Ellen Reilly

(57) ABSTRACT

An infant crib wherein the crib portion is elevated in order to accommodate a wheelchair passing under the crib bed. The invention is preferably comprised of spaced support members supporting a horizontal base member at an elevated position high enough to accommodate the seat portion of a wheelchair beneath the base member. There is at least one side panel surrounding the base member slidable laterally between a closed and open position to enable a person seated in a wheelchair to have access to an infant placed on the base member when the slide panel is in the open position. A drawer member is positioned under the base member to allow a person seated in a wheelchair to have access to any necessary items.

16 Claims, 5 Drawing Sheets

ELEVATED INFANT CRIB DESIGNED FOR WHEELCHAIR ACCESS

BACKGROUND AND FIELD OF INVENTION

This invention relates to an infant crib and more particularly relates to a novel and improved infant crib elevated to accommodate a wheelchair beneath the crib bed.

Over the years a number of infant cribs have been developed to accommodate various special needs. There is specifically lacking, in the area of infant cribs, an elevated crib designed to allow the seat portion of a wheelchair to pass under the crib bed. Typical cribs have a rail or panel that is capable of sliding vertically. The raising and lowering of the side panel prevents any object, such as a wheelchair, from passing underneath the crib bed. Further, typical infant cribs are not elevated to the extent of allowing a wheelchair to pass underneath the crib bed.

It has been found that by elevating the crib bed, mounting the side panel to slide laterally and adding a drawer to hold infant necessities within hand's reach, the problems encountered by individuals who are wheelchair-bound, seeking to attend to an infant inside of the crib are addressed. Further, this infant crib may also be used by individuals requiring an elevated crib due to aging, a bad back or similar condition, alleviating the need to excessively bend over while tending to an infant inside the crib.

SUMMARY OF THE INVENTION

It is therefore an object of the present invention to provide for a novel and improved infant crib wherein the crib is elevated to accommodate a wheelchair passing underneath the crib bed.

It is another object of the present invention to provide for a novel and improved infant crib in which at least one side panel is laterally slidable between a closed and open position to enable a person in a sitting position or confined to a wheelchair to have access to an infant in the crib.

It is another object of the present invention to provide for a novel and improved infant crib having a drawer secured under the crib bed at arm's reach of the person seated in a wheelchair, in order to obtain any necessary infant products, such as, diapers, lotions or creams.

It is another object of the present invention to provide for a novel and improved infant crib in which a lateral sliding side panel has a stop mechanism preventing the panel from sliding completely off the slide rail.

It is a further object of the present invention to provide for a novel and improved infant crib in which the lateral sliding side panel is prevented from disengaging from the slide rail through use of a modified side rail and can be easily moved by one seated in a wheelchair.

Another advantage of the present invention is that the lateral sliding side panel can be secured to a crib frame in such a way as to prevent an infant from inadvertently falling out of the crib.

A further advantage of the present invention is that an individual confined in a wheelchair may tend to an infant located inside of the crib while at the same time retrieving any necessary articles without leaving the infant unattended.

In accordance with the present invention, there is provided an infant crib that broadly comprises a horizontal base member with spaced support members attached and supporting the base member at an elevated position high enough to accommodate the seat portion of a wheelchair beneath the base member, and including upright slide panel means slidable laterally between a closed and open position. A drawer or platform is attached to the base member allowing quick access to any infant necessities.

There has been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENT

Figure 1:
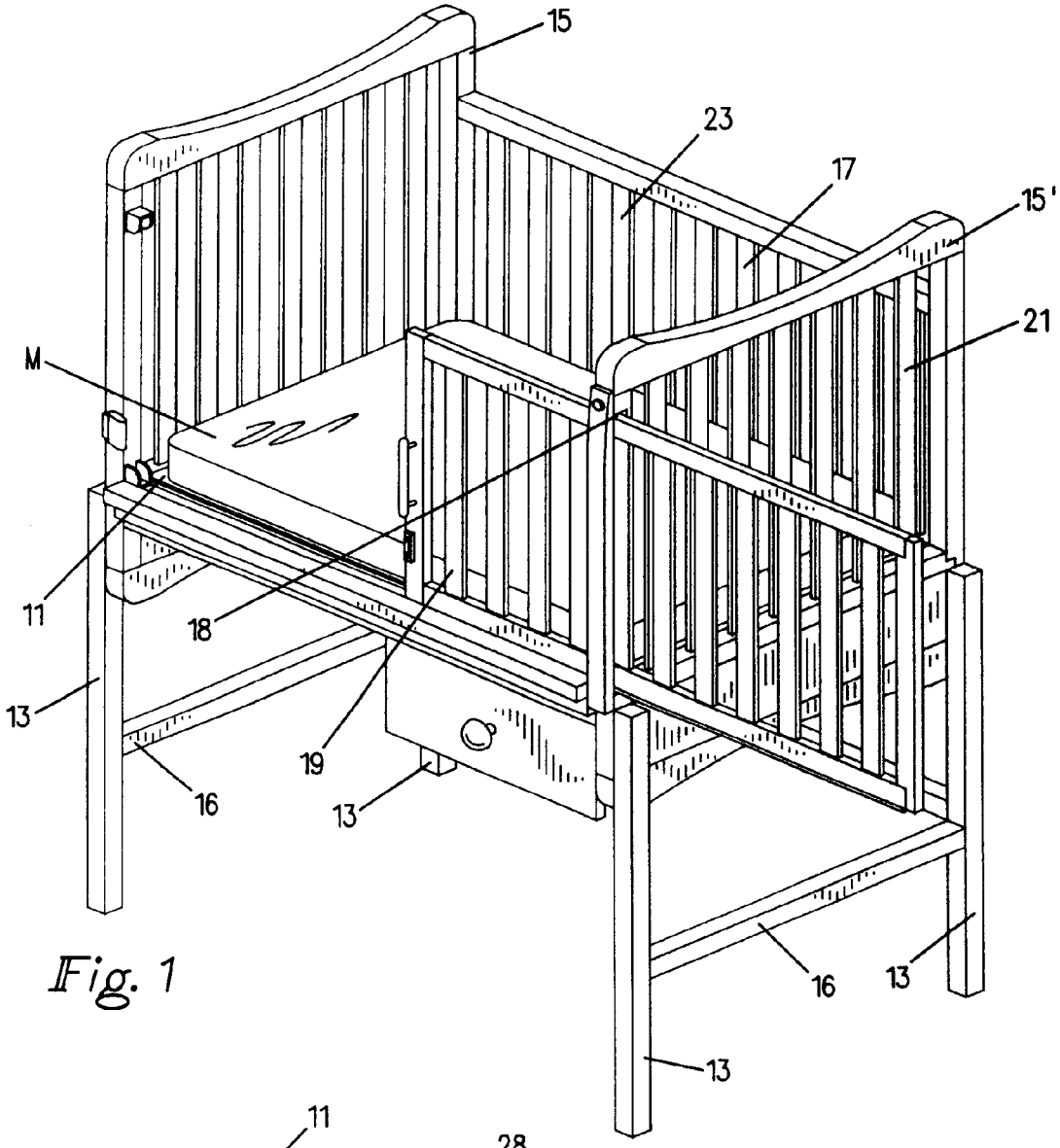
FIG. 1 is a perspective view of a preferred form of the invention.

The following describes the preferred embodiment of the invention and variations of that embodiment. Referring to FIG. 1, an elevated infant crib comprises a horizontal base member 11 adapted to receive a mattress "M" so as to form a rectangular bed 21, and four spaced leg or support members 13 supporting the base member 11 at an elevated position high enough to accommodate a chair or wheelchair and its occupant being advanced beneath the base member. Side panels 15, 15' and 17 are designed to surround the rectangular base member 11 including a side panel 19 which is laterally slidable between a closed and open position. The spaced leg members are dimensioned so as to allow passage of a chair or the seat portion of an adult wheelchair beneath the base member 11. See FIG. 8. Preferably, the legs 13 and rectangular bed 21 are composed of a rigid material, such as, wood or molded plastic in order to support the weight of a large infant.

The end panels 15 and 15' are shorter than side panels 17 and 19 and are affixed at one end to the side panel 17. The end panels 15 and 15' are preferably higher than the side panels 17 and 19, and all panels 15, 15', 17 and 19 are comprised of evenly spaced vertical bars 23. Side panel 15' is modified at upper rail corner 18 to accommodate passing through of lateral sliding side panel 19.

Figure 2A:
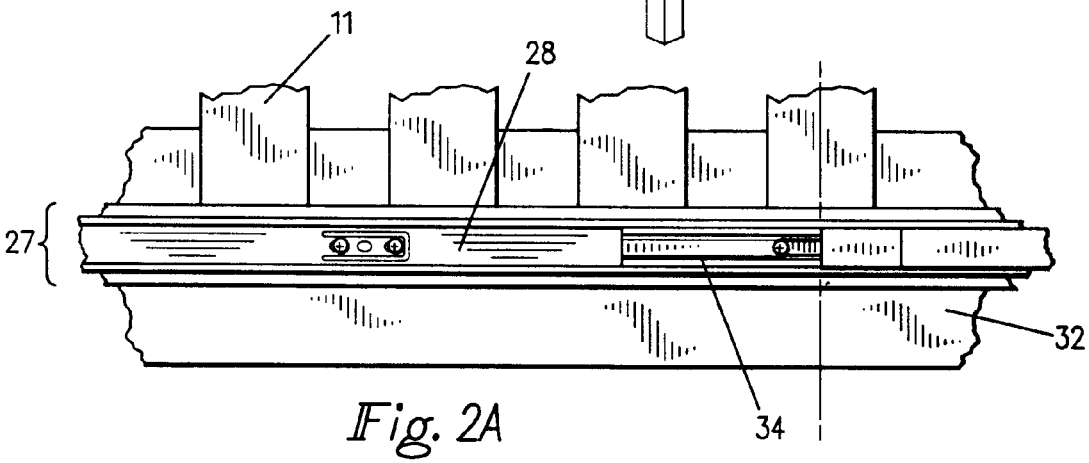
FIG. 2A is a fragmentary perspective view of the slide mechanism underlying the lateral sliding side panel.
Figure 2B:
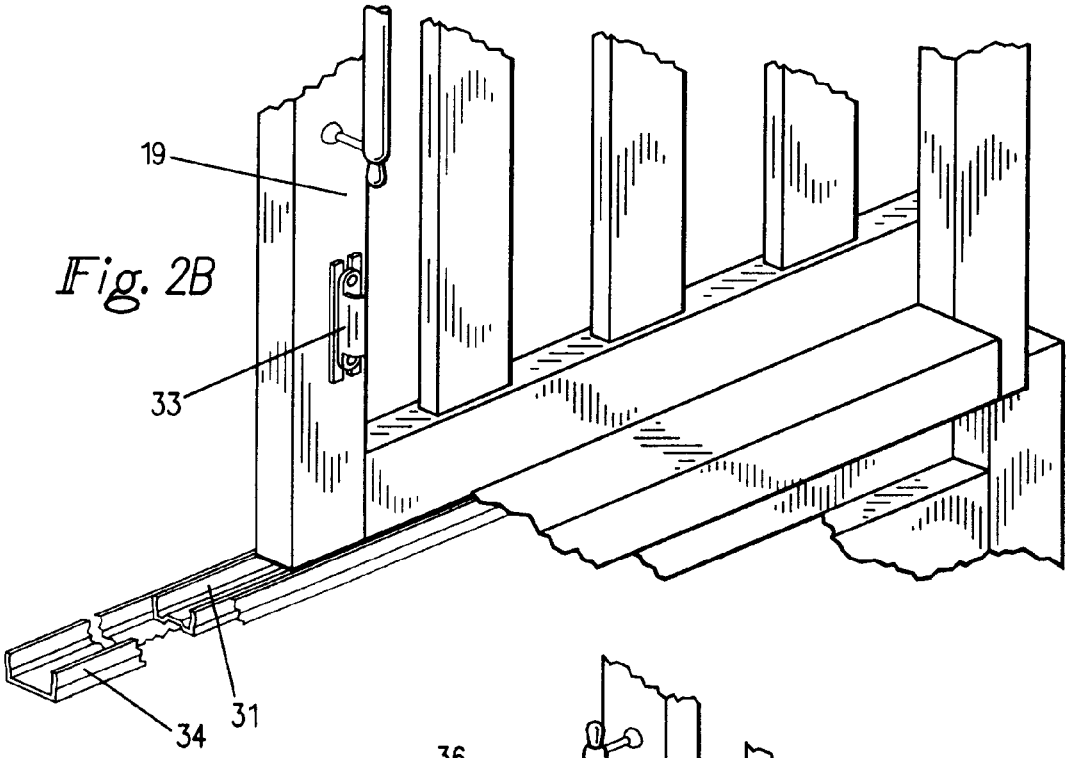
FIG. 2B is a fragmentary perspective view of the lateral sliding side panel and slide mechanism.
Figure 4A:
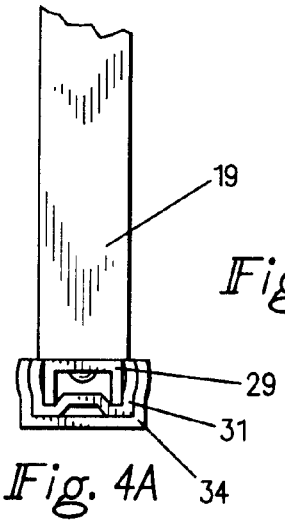
FIG. 4A is a fragmentary side view of FIG. 2B, demonstrating the lateral sliding side panel with slide mechanism.
Figure 4B:
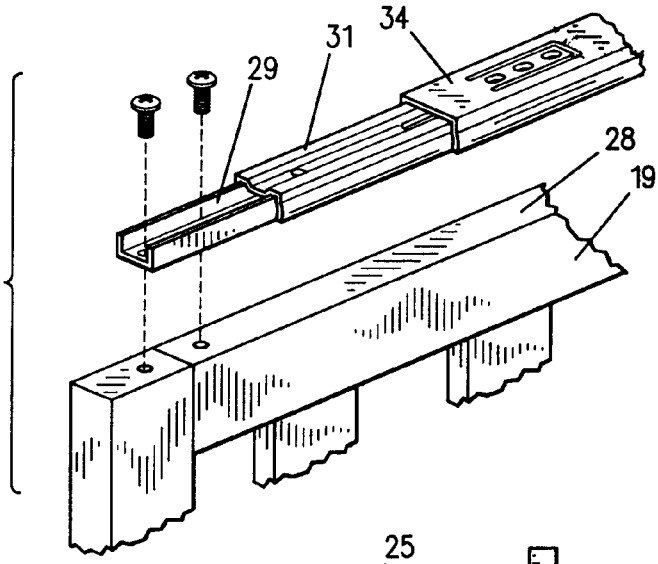
FIG. 4B is a fragmentary perspective view demonstrating the attachment of the slide mechanism to the base portion of the sliding side panel.

Referring to FIG. 2A and 2B, a slide or guide mechanism 27 is demonstrated to enable the side panel 19 to slide laterally. The slide mechanism 27 comprises a stationary channel member 34, as indicated in FIGS. 4A and 4B, which is mounted on the outer edge 32 of the base member 11. Telescoping slide member 31 is designed to fit securely within the stationary channel member 34 and corresponding opposing channel member 29 is anchored to the undersurface of the slide panel 19 as demonstrated in FIG. 4B. The slide mechanism 27 guides the sliding panel 19 along the outer edge 32 of the base member 11 while preventing tilting of the sliding panel 19 in conjunction with the modified upper rail corner 18.

Telescoping slide member 31 includes a stop element that is designed to prevent the sliding panel 19 from sliding completely off of the stationary channel member 34 while also limiting the opening movement of the sliding panel 19. Slide mechanism 27 is a standard slide mechanism such as the ACCURIDE® Model No. 3832B manufactured by Accuride International, Inc., Santa Fe Springs, Calif.

Figure 3:
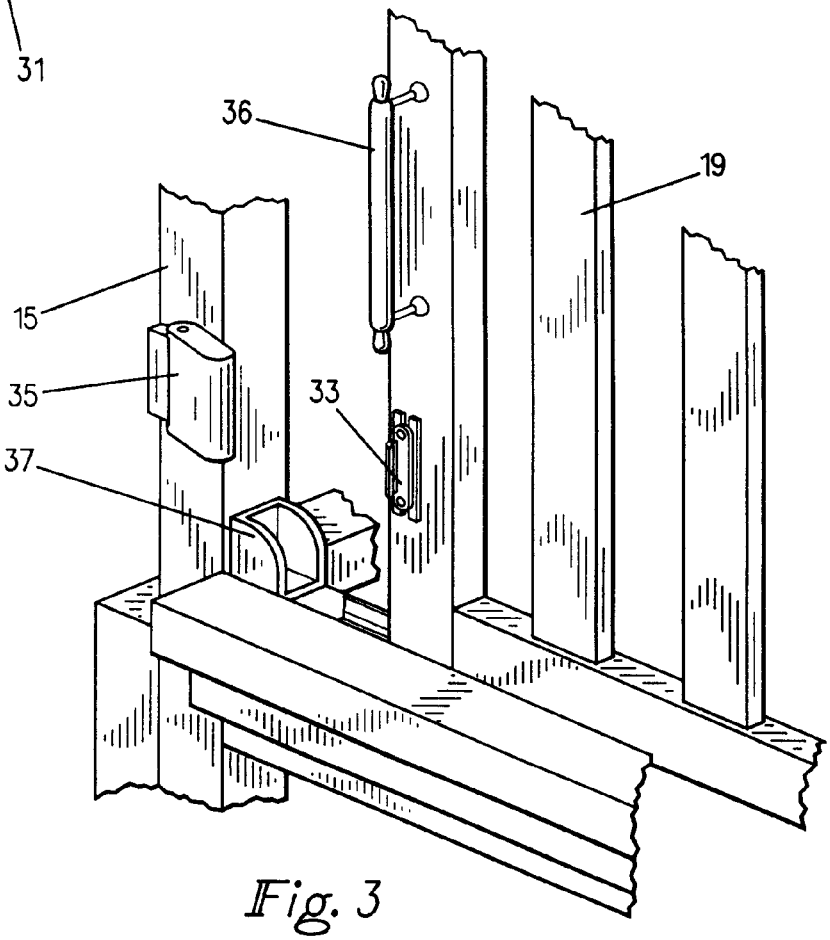
FIG. 3 is a fragmentary perspective view of the lateral sliding side panel including a side panel housing.

Referring to FIG. 3, the clip housing 33 for the latching mechanism 35 is adapted to be secured to the opposite side panel 15 through a latching mechanism 35. Also in FIGS. 3 and 5 there are upper and lower side panel housings 37' and 37 to receive the upper and lower corners of the side panel 19 so as to enable latching of the latching mechanism 33 and 35. Handle means 36 is located on sliding side panel 19 to enable a person to easily slide the panel 19 laterally between an open and closed position.

Figure 5:
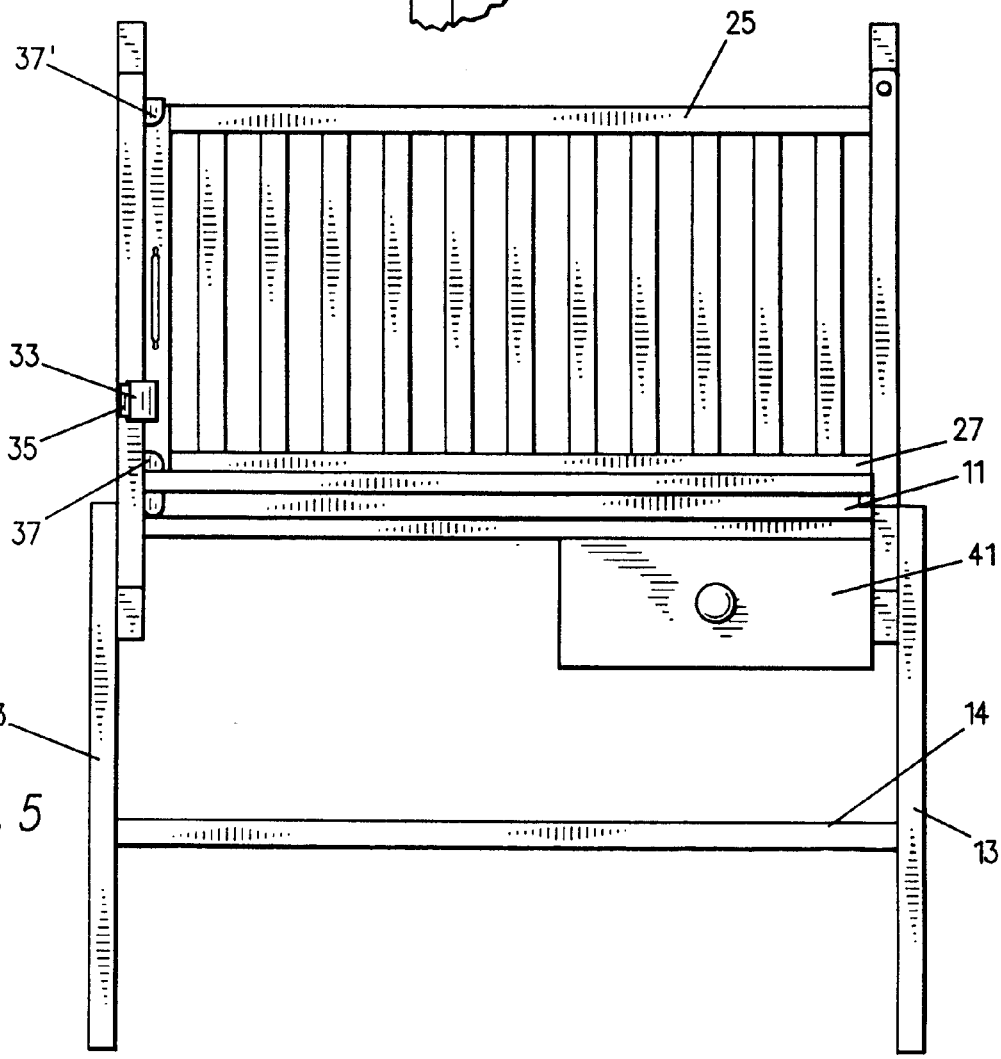
FIG. 5 is a front view of the preferred embodiment.

FIG. 5 also shows the frame support member 14 attached at opposite ends of spaced leg members 13. Further referring to FIG. 1, there are additional frame end support members 16 attached to spaced leg members 13. FIG. 5 also demonstrates a drawer member 41 that is attached to the underside of the base member 11. The drawer member 41 is preferably formed of the same material as the spaced leg members 13 and rectangular bed 21. Referring to FIG. 6B, the drawer member 41 is adapted to receive any infant necessities and may also contain a circular rotating disk 43 capable of manual rotation which enables the user to have easy access to all items contained within the drawer.

Figure 6A:
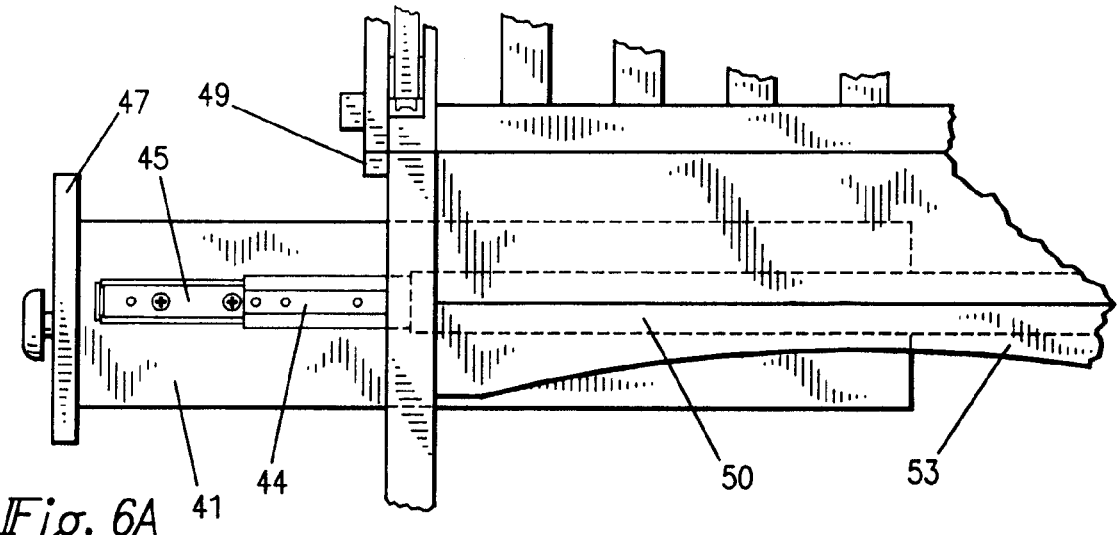
FIG. 6A is a fragmentary side view of the drawer underlying the crib bed.
Figure 6B:
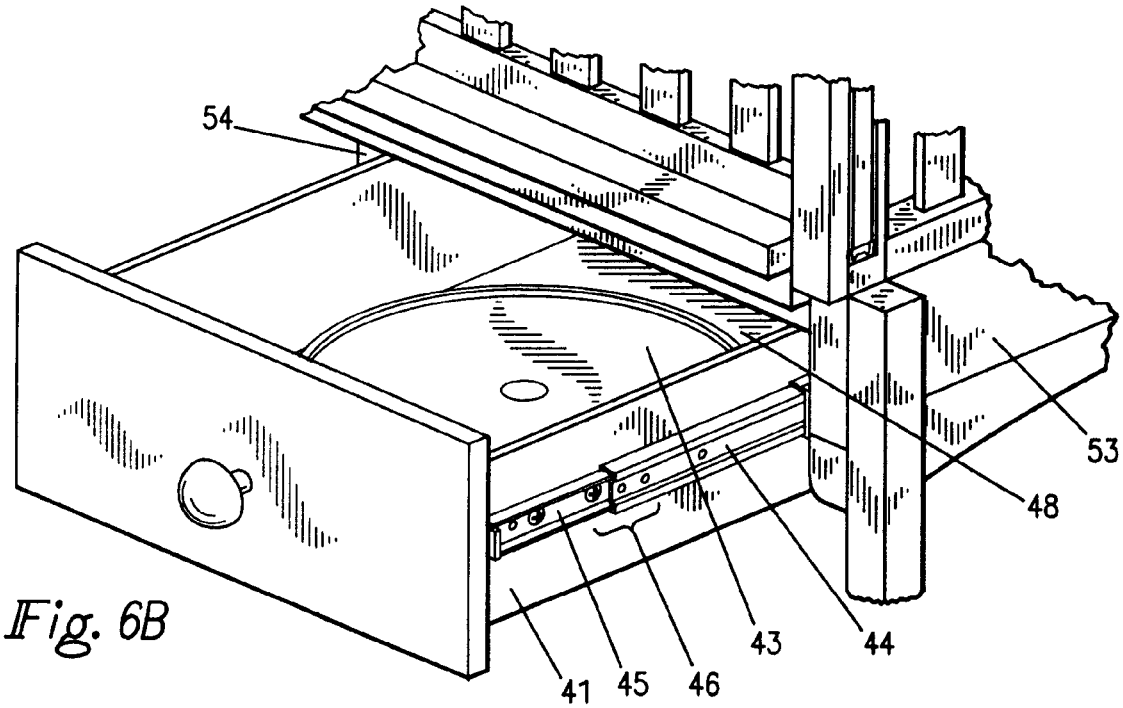
FIG. 6B is a fragmentary perspective view of the drawer attached to the underside of the crib bed, containing a circular turntable for organization of infant necessities.

Referring to FIGS. 6A and 6B, the drawer member 41 has stationary channel members 45 mounted on opposite sides of the drawer member 41 and coupled with telescoping slide members 44 adapted to surround the stationary channel members 45 and 45'.

Figure 7:
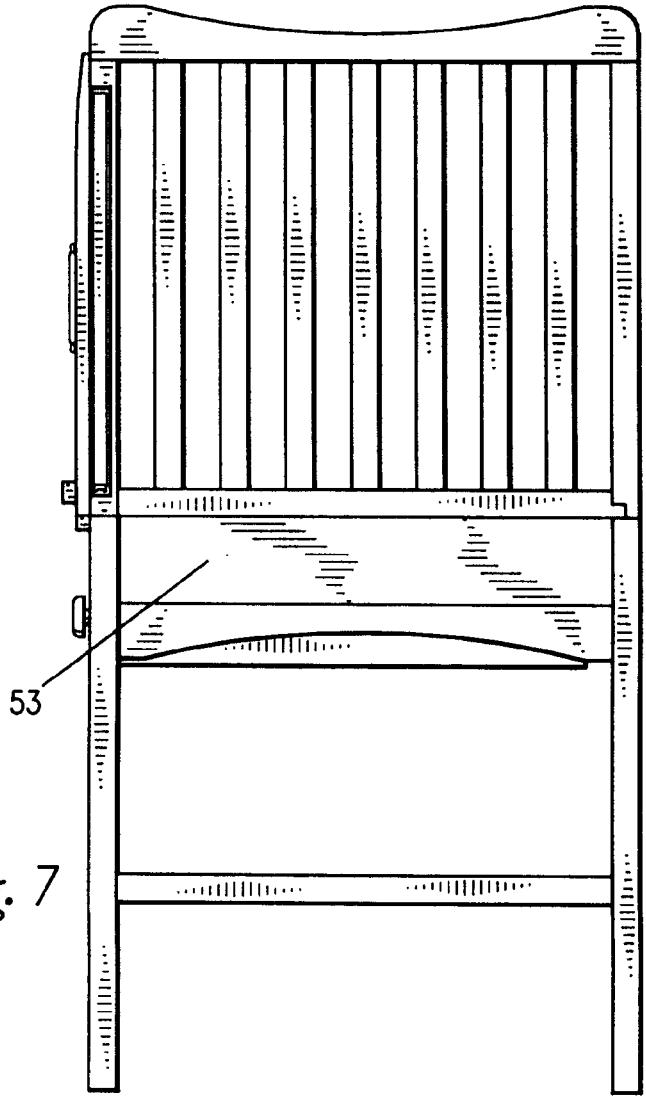
FIG. 7 is a side view of the preferred embodiment of the invention.

Referring to FIG. 6A, 6B and 7, the face 47 of the drawer member 41 is adapted to lay flush with the lower surface of the base member 49. Telescoping slide members 44 and 44' (partially shown) conform to and fit securely within stationary side rail members 50 which are secured to side panel members 53 and 54.

A platform could be substituted for the drawer member 41 comprising solely the bottom panel 48 of the drawer member 41 which would support the circular rotating disk 43 and the drawer slide mechanisms 46 to be placed on the side edges of the bottom panel 48.

Figure 8:
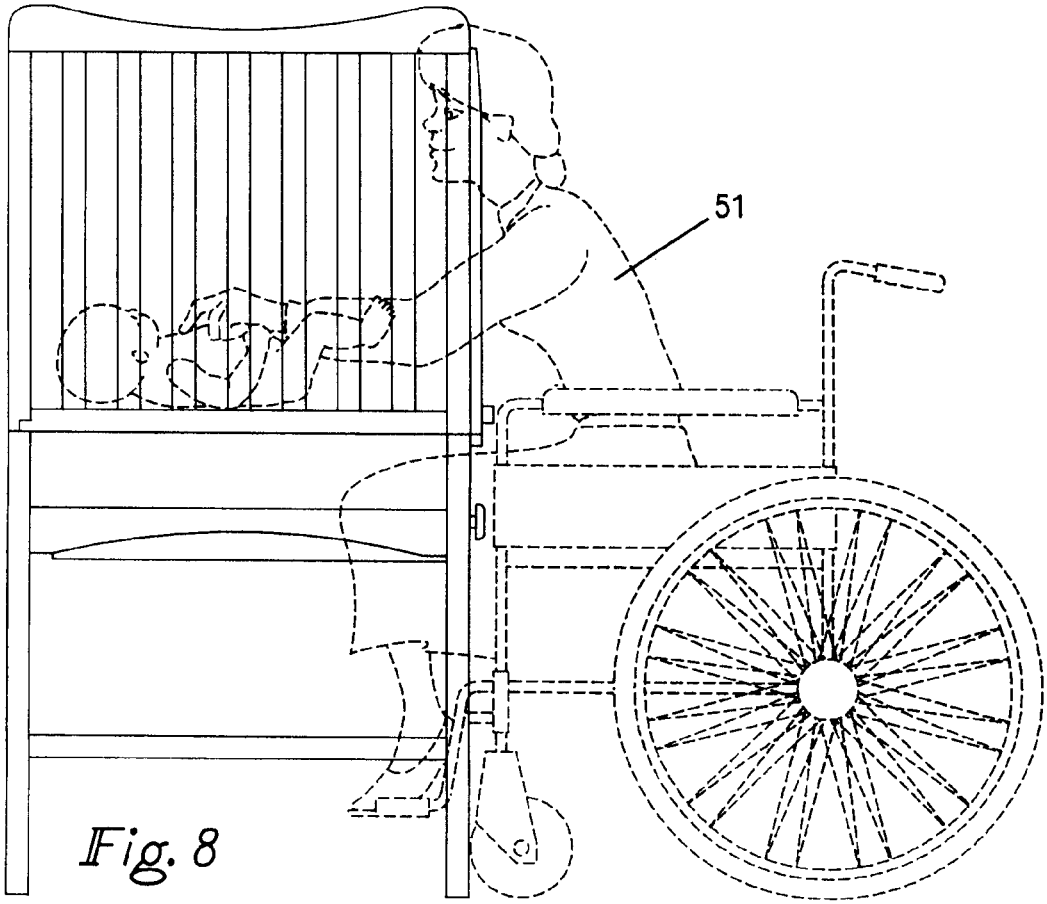
FIG. 8 is a side view showing a figure in a wheelchair passing under the crib bed attending to an infant placed on top of the crib bed.

FIG. 8 demonstrates the use of the elevated infant crib whereby a person seated in a wheelchair may advance with the seat portion of the wheelchair underneath the base member 11 and have access to an infant on the base member when the lateral sliding side panel 19 is in the open position.

The invention is practiced by a person seated in a wheelchair 51, positioning themselves underneath the base member 11, sliding the lateral sliding side panel 19 to the open position using handle means 36, and placing an infant on the base member 11. If a person so desires, the drawer member 41 may be opened to reveal infant necessities displayed on a revolving turntable 43 that are within arm's reach. If the infant is to be left in the infant crib, the lateral sliding side panel 19 can be placed in the closed position, utilizing the side panel housings 37, 37' whereby the latching mechanisms 33 and 35 are utilized. Upper rail piece 18, as shown in FIG. 1, insures that the side panel 19 does not disengage from the slide mechanism 27 when placing side panel 19 in an open or closed position.

It will be evident that the present invention may also be utilized by individuals with various health problems that are unable to bend over, even for short periods of time, in order to address an infant's needs.

It is therefore to be understood that while preferred forms of invention are herein set forth and described, various modifications and changes may be made therein without departing from the spirit and scope of the present invention as defined by the appended claims and reasonable equivalents thereof.

I claim:

1. An infant crib comprising:

a horizontal base member adapted to receive a mattress;

spaced support members supporting said base member at an elevated position high enough to accommodate a seat portion of a wheelchair and its occupant beneath said base member;

upright end and side panels surrounding said base member; and slide panel means for sliding one of said side panels beyond one of said end panels to an open position beyond one of said end panels whereby to enable a person seated in said wheelchair to have access to said base member and to an infant on said base member when said sliding side panel is in the open position.

2. An infant crib according to claim 1 wherein there are four of said spaced support members supporting said base member.

3. An infant crib according to claim 1 wherein said crib is rectangular and said side and said end panels are in facing relation to one another surrounding said base member.

4. An infant crib according to claim 3 wherein said sliding side panel is releasably connected at one end to an opposing end of one of said end panels.

5. An infant crib according to claim 3 wherein said side and end panels comprise evenly spaced vertical bars.

6. An infant crib according to claim 1 including a drawer member mounted beneath the horizontal base member.

7. An infant crib comprising:

a horizontal base member adapted to receive a mattress;

spaced leg members supporting said base member at an elevated position high enough to accommodate a seat portion of a wheelchair and its occupant beneath said base member;

upright end and side panels surrounding said base member;

a drawer member mounted beneath said horizontal base member adapted to contain items of need for an infant; and slide panel means for sliding one of said side panels beyond one of said end panels to an open position whereby to enable a person seated in said wheelchair to have access to said base member and to an infant on said base member when said sliding side panel is in the open position.

8. An infant crib according to claim 7 wherein said slide panel means comprises a stationary channel member, a telescoping slide member, and an opposing channel member disposed within said telescoping slide member.

9. An infant crib according to claim 8 wherein said opposing channel member is mounted on an undersurface of said sliding side panel whereby to allow said sliding side panel to slide horizontally with respect to said base member.

10. An infant crib according to claim 9 wherein said slide panel means is adjustable to determine the degree of opening of said sliding side panel.

11. An infant crib according to claim 7 wherein said drawer member includes a circular turntable.

12. An infant crib according to claim 7 wherein said horizontal base member is surrounded by opposite side and end panels and forms a rectangular bed.

13. An infant crib according to claim 7 wherein said side and end panels comprise evenly spaced vertical bars.

14. An infant crib comprising:

a horizontal base member adapted to receive a mattress;

four spaced leg members supporting said base member at an elevated position high enough to accommodate a seat portion of a wheelchair beneath said base member;

upright end and side panels surrounding said base member including an upright slidable side panel along one side of said base member being horizontally slidable between an open and closed position;

one of said end panels includes support means for advancing said slidable side panel beyond said end panel to an open position; and a drawer member mounted beneath said horizontal base member including a circular turntable.

15. An infant crib according to claim 14 wherein said slidable side panel is adjustable to determine the degree of opening of said slidable side panel.

16. An infant crib according to claim 14 wherein said slidable side panel has a handle at one end thereof.

* * * * *